United States Patent [19]

Finke et al.

[11] Patent Number: 4,903,828

[45] Date of Patent: Feb. 27, 1990

[54] BOTTLE CLOSURE CAP FOR TWO-COMPONENT PACKAGES

[75] Inventors: Robert G. Finke, Finnentrop; Clemens Schumacher, Sundern, both of Fed. Rep. of Germany

[73] Assignee: Robert Finke Kommanditgesellschaft, Finnentrop, Fed. Rep. of Germany

[21] Appl. No.: 23,061

[22] Filed: Mar. 6, 1987

[30] Foreign Application Priority Data

Mar. 7, 1986 [DE] Fed. Rep. of Germany ... 8606224[U]

[51] Int. Cl.[4] ..... B65D 51/24

[52] U.S. Cl. ..... 206/221

[58] Field of Search ..... 215/DIG. 8; 206/221

[56] References Cited

U.S. PATENT DOCUMENTS

| | | | |
|---|---|---|---|
| 4,203,517 | 5/1980 | Hildebrandt et al. | 215/DIG. 8 |
| 4,563,186 | 1/1986 | Flynn et al. | 206/221 X |
| 4,591,050 | 5/1986 | Finke et al. | 215/DIG. 8 |

FOREIGN PATENT DOCUMENTS

| | | |
|---|---|---|
| 190593 | 8/1986 | European Pat. Off. . |
| 2544328 | 4/1976 | Fed. Rep. of Germany . |
| 8502008 | 10/1985 | Fed. Rep. of Germany . |
| 2342914 | 9/1977 | France . |

*Primary Examiner*—Donald F. Norton

*Attorney, Agent, or Firm*—Martin A. Farber

[57] ABSTRACT

A bottle closure cap for two-component packages is formed with a collar extending from the bottom of a cup-shaped cap which has a bottle screw-on thread on the inner wall of the cup. The collar connects via a thread which is directed opposite the bottle-screw-on-thread, to a beaker which can be brought over projections seated on an outer side of its beaker cylindrical wall into a non-rotatable but axially displaceable coupling engagement with the inner wall of a bottle neck. A front end of the collar comes into form-locked engagement by an annular groove on the bottom of the beaker.

7 Claims, 4 Drawing Sheets

BOTTLE CLOSURE CAP FOR TWO-COMPONENT PACKAGES

FIELD AND BACKGROUND OF THE INVENTION

The present invention relates to a bottle closure cap wherein a bottle closure cap for two-component packages is formed with a collar extending from the bottom of a cup-shaped cap which has a bottle screw-on thread on the inner wall of the cup. The collar connects via a thread which is directed opposite the bottle-screw-on thread, to a beaker which can be brought over projections seated on an outer side of its beaker cylindrical wall into a non-rotatable but axially displaceable cooling engagement with the inner wall of a bottle neck.

Depending on the nature of the coupling engagement, the component of the bottle contents which is held ready as concentrate in the small-volume beaker is freed for mixing with the second component of the bottle contents contained in the bottle upon the threaded association, or else only upon the unscrewing of the closure cap.

The object of the invention is to develop a bottle closure cap of this type in a manner which is optimal for use and for filling.

SUMMARY OF THE INVENTION

According to the invention, the front end (7') of the collar (7) comes into form-locked engagement in an annular groove (14) on the bottom (15) of the beaker (8).

As a result of this development, there is obtained a bottle closure cap of this type which is of increased value in use. This can be noted in particular from the high beaker sealing closure obtained. The entrance of the front end of the collar of the closure cap into an annular groove in the beaker leads practically to a double seal. The inner and outer walls of the front-side collar lie firmly against the corresponding annular surfaces of the annular groove. Since, in addition to this, the seal lies in the region of the bottom of the beaker, the entire length of the beaker can be maximally utilized as filling space. The excess length of the beaker (beaker wall), which is in any event necessary for the sealing, disappears in the annular groove. In order to avoid the concentrate passing into the region of the seal upon the closing, it is possible, by inverting the closure cap and accordingly with the collar directed upward, to fill the latter like a beaker. The cup-shaped closure cap in any event has a larger diameter and is therefore stabler upon standing, for instance upon automatic loading on a belt conveyor. After the filling, the beaker, with its opening now directed downward, is attached in the manner of a cap, i.e. screwed on. The corresponding turning movement of the two parts to be connected with each other additionally favors a tight closure on the bottom side; the front end of the collar turns into the annular groove. It furthermore proves advantageous that the annular groove on the bottom of the beaker is so close to the cylindrical wall of the beaker that said wall, together with an annular step of the bottom of the beaker, forms a U-shaped profile as seen in cross section. This leads to an increase in the flexibility of the adaptation of the flanks of the groove forming the sealing surfaces. Tolerance-caused deviations at the front end of the collar are tolerated better. The front end which enters in sealing manner also has a good ability of adaptation insofar as the front end of the collar which enters into the annular groove is reduced in its wall thickness. Increased flexibility results from this. In addition to this, it is advantageous that the coupling engagement projections are formed by radially protruding, axially extending ribs the bottom-side end region of which extends to below the annular bottom zone of the annular groove. In addition to the driving funtion of such coupling projections, they also serve the function of a stabilizing supporting mechanism. The beaker wall can therefore be selected very thin. The continuation of the coupling projections to below the annular bottom zone of the annular groove thus also stiffens the U-shaped profile in the region of the bottom. The beaker-side anchoring of the projections is also better. In addition to this, it is proposed that the axial course of the ribs extend over the entire axial length of the cylindrical wall of the beaker. In this way the load on the ribs is distributed, either by the claws of a screwing-on tool or in combination with the coupling engagement, over a larger region of the cylindrical wall of the beaker. Furthermore, the measure that the inner wall thereof bears stiffening ribs produces a stabilizing effect for the collar. The sealing zone is, of course, excepted from this. Finally, another advantageous feature is that, adjacent to the bottle neck, there is a second bottle neck with identically shaped thread on which there is seated a second closure cap, the cup rim of the closure cap being seated in sealing manner on a shoulder of the bottle neck, for which purpose the length of the bottle neck is made shorter than the axial length of the cup cylindrical wall of the closure cap. The mixing is brought about by simple interchanging of the closure caps. In this way there is obtained a container which leaves the time of mixing up to the consumer without overstraining him with respect to the handling. He need merely interchange the closure caps down.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 2:
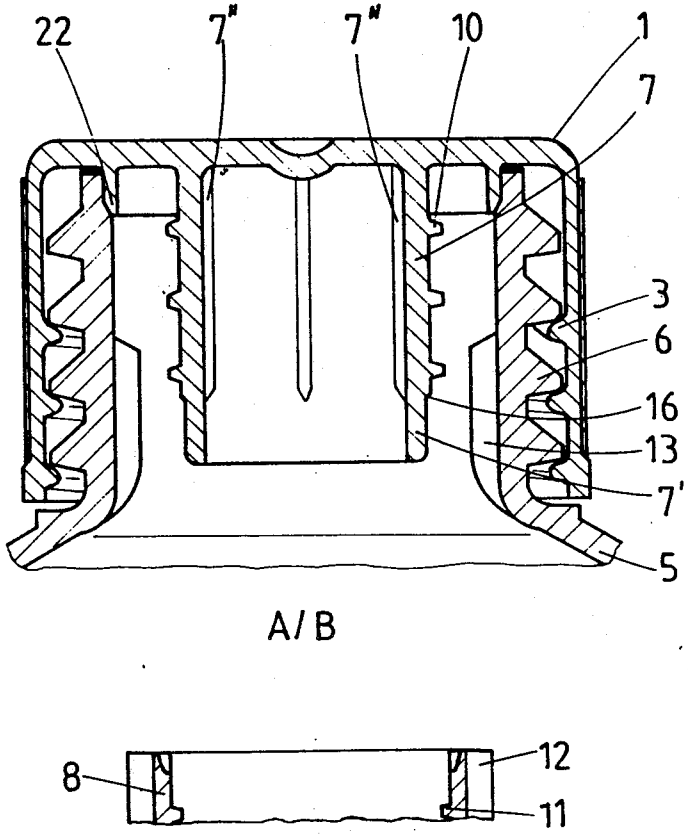
FIG. 2 shows this bottle closure cap after the end of the screwing-on movement and after the beaker has been screwed off, the two components A and B being together

The cup-shaped bottle closure cap 1 shown bears on its cup inner wall 2 a bottle screw-on thread 3. The latter, starting from the cup edge 4, extends approximately up to the mid-height of the inner wall 2 of the cup. It may be a single-start or a multi-start thread.

The bottle neck I is developed on a bottle 5 in the shape of a cylindrical connection and bears a corresponding mating thread 6 for the bottle screw-on thread 3.

The lower flank of this mating thread 6 is steeper than the upper flank. There is a sawtooth structure.

The bottle closure cap 1 is equipped to receive a first component A of bottle contents. A second component B of bottle contents is received by a The receiving space for the first component A, for instance in the form of a concentrate such as plant protective agent, beverage syrup or the like, is formed by a collar 7 developed on the closure cap 1, in combination with a beaker (container) 8 screwed thereon. The collar 7 extends from the flat bottom, or cover, of the cup-shaped closure cap 1. It (7) extends concentrically to the cylindrical cup wall W and, with the closure cap 1 screwed on, extends into the bottle-neck opening 9.

The thread formed on the cylindrical wall of the collar 7 is designated 10 and cooperates with a corresponding mating thread 11 on the inner wall of the beaker 8. In this connection, the mating thread 11 is developed as a two-start thread. This thread is developed as a left-hand thread while the thread between closure cap 1 and the mating thread 6 of the bottle neck I is developed as a right-hand thread.

The corresponding opposition of the thread directions is utilized in order to obtain an unscrewing of the beaker 8 from the collar 7 upon the screwing-on of the closure cap 1. For this purpose, rotation-blocking means are inserted between bottle neck I and beaker 8. On the beaker side, these are axially directed projections 12 while on the bottle-neck side they are ledges 13 which extend into the bottle-neck opening 9. The coupling engagement which holds the beaker 8 fast occurs only after a screwing-on movement of about 360° and, in any event, in a phase in which the thread engagement is present between 3 and 6.

Figure 1:
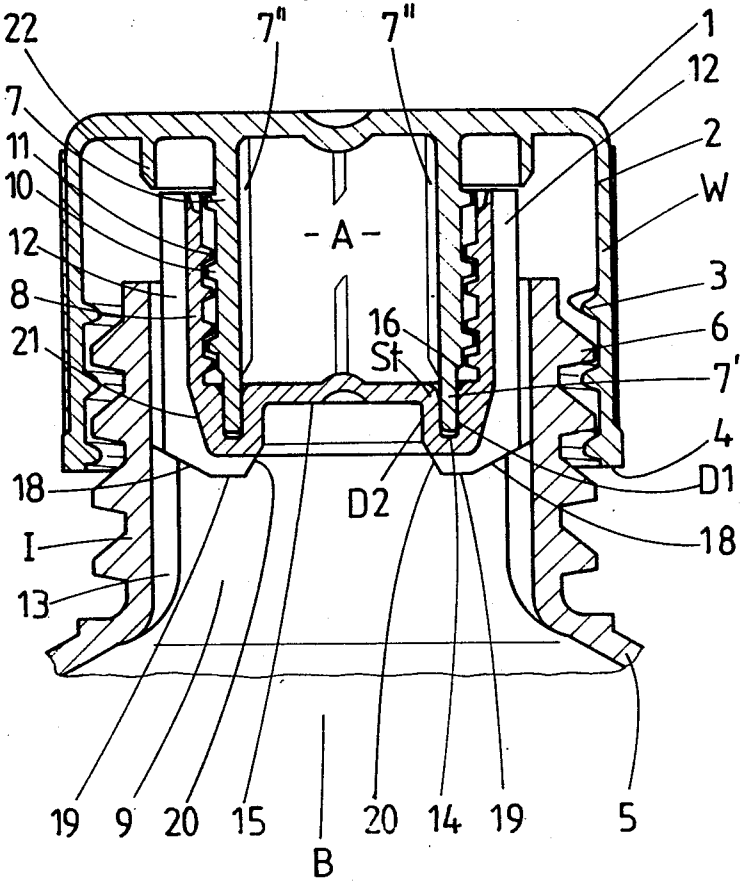
FIG. 1 is a vertical section through the bottle closure cap developed in accordance with the invention seen during the association phase, with bottle neck shown only in part the two components A and B of bottle contents being separated

As can be noted from FIG. 1, the ledges 13, which are also axially aligned, commence only at the mid-height of the bottle neck I. The mouth-side region in front thereof accordingly does not act to prevent turning; it therefore permits the unimpeded carrying along in rotation of the beaker 8 which is screwed onto the collar 7. After the passing of the oppositely directed front ends of the projections 12 and ledges 13, the coupling engagement is produced as a result of the thread.

In order to obtain a highly effective sealing of the first component A, the face end 7' or the free edge of the collar 7, engages in form-locked manner into an annular groove 14 of the beaker 8. This annular groove is formed, on the one hand, by the central pushing-in of the bottom 15 of the beaker. This leads to a U-shaped profile in the edge region of the beaker bottom 15 and to two sealing places D1 and D2 on the cylindrically extending flanks of rotational symmetry of the annular groove 14 and the corresponding circumferential mating surfaces of the front end 7'. The pushing-in leads to an annular step St which extends with axial spacing from the free front edge of the collar.

As can be clearly noted from FIGS. 1 and 2, the front end 7' is reduced in thickness over at least an amount equal to the depth of the groove, this being done by the removal of the collar 7 on the side of the outer circumferential wall. The transition step between the two regions of different thickness is designated 16. It is an oblique step which has an oblique angle of more than 120° so that any notch effect is avoided.

The inner and outer edges of the front end 7' of the collar are beveled. This and a funnel-shaped beveling of the entrance of the annular groove 14 lead to an advantageous centering effect which favors the threaded association of the beaker 8 and the screwing-in of the collar 7 in same. The sealing places D1 and D2 which are arranged in pairs can lie under additional sealing tension, on basis of a slight initial tensioning of the U-profile as a result of a resilient force which can be obtained therefrom.

As a result of the reduction in the cross section of the front end 7', higher flexibility or elasticity results and thus also good adaptability, so that an optimum sealing closure is present. Upon the entrance of the front end 7' into the annular groove 14, the remaining air is displaced as a result of the form-locked engagement, i.e. the air can escape from the U-shaped slot as a result of the flexibility of the groove-forming sections of the U-profile. Since the sealing closure takes place only at the last moment as a result of the arrangement of the annular groove 14 on the bottom side, no internal pressures are produced.

Figure 3:
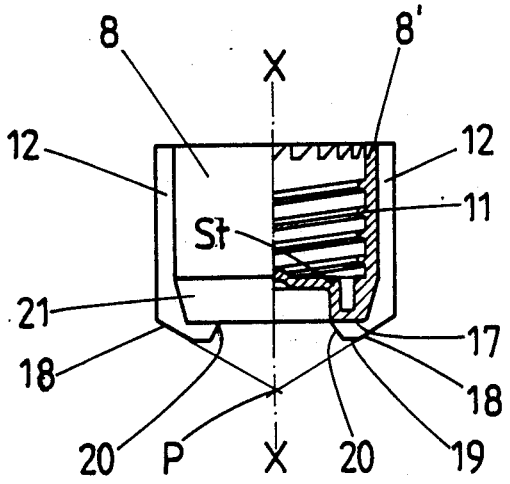
FIG. 3 shows the beaker by itself, seen in a half section.
Figure 4:
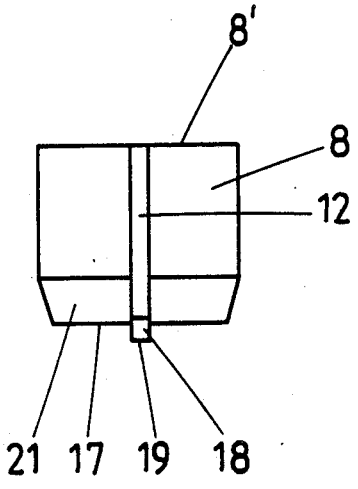
FIG. 4 is a side view corresponding thereto.

As can be seen with the aid of FIGS. 3 and 4, the projections 12 are formed by radially protruding, axially extending ribs. The height and breadth of these ribs correspond essentially to the thickness of the beaker wall. The ribs commence at the height of the beaker edge 8' and extend to below the annular bottom zone 17 of the annular groove 14. The corresponding engagement underneath can be noted clearly from FIG. 3. The back of the rib extends straight up to the height of this annular zone; only as from this point is there a beveling 16 of the projections which converges in the direction of the longitudinal center axis x—x of the beaker 8. After a zone of passage 18 directed parallel to the bottom 15 of the rib then again rises obliquely. This section bears the reference number 20 and terminates on the inner edge of the bottom protuberance. As a result of this contour there is obtained for the lower region a stabilizing stiffening of the annular groove 14, for instance at two diametrically opposite zones of the beaker 8. More than two projections 12 of the cylindrical wall of the beaker 8 can also be provided.

The lower beaker section is developed conically on its outer side over an axial height which corresponds approximately to the depth of the annular groove 14. The taper lies in the direction of the point of intersection p of the converging bevels 18 of the ribs 18. In addition to a stabilizing of these zones, the root region of the ribs is also enlarged, i.e. the ribs included in the coupling engagement prove to be rather stable. The point p lies at a distance from the bottom annular zone 17 which corresponds approximately to the radius of the cylindrical beaker 8.

Figure 5:
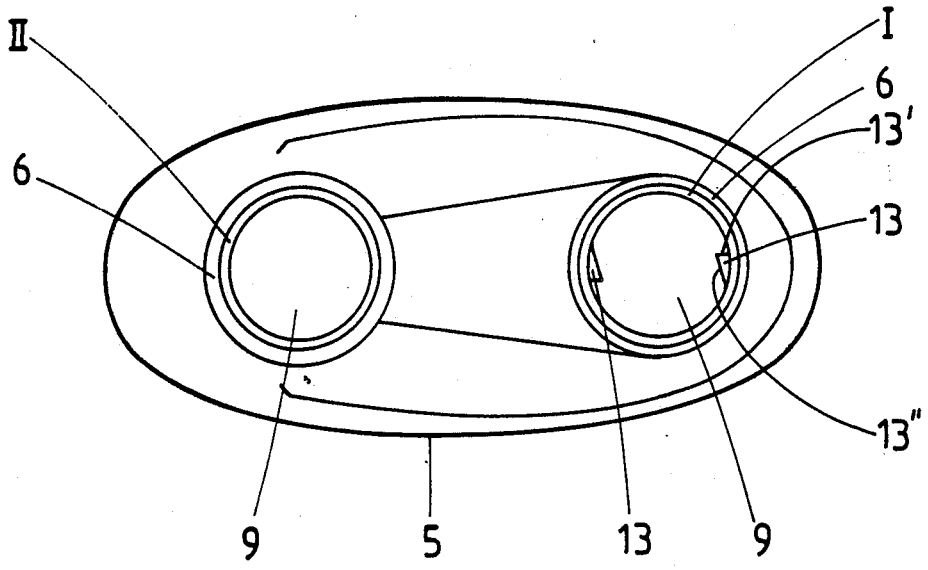
FIG. 5 is a top view of a complete bottle.

The bottle-side mating means in the form of ledges 13 which cooperate with the projections 12 are of a sawtoothlike cross section, i.e. they have a steep flank 13' shown in FIG. 5, and a fleeing flank 13''. The steep flank 13' is directed substantially towards the center of the bottle neck opening 9. Opposite it is the correspondingly steeply arranged corresponding side of the projection 12.

For the filling of the concentrate which represents the first component A, the bottle closure caps 1 are placed on the back, so that the opening of the collar 7 faces upward. The filling is then effected. Via a feed device, the beaker 8 is screwed on in cap-like manner from above. In this connection, the front edge 7' turns itself in sealing manner into the annular groove 14.

If now such a mini-capsule is associated with a bottle neck I of the type described, then the projections 12 arranged on the cylindrical wall of the beaker finally come into non-turnable but axially displaceable coupling engagement with the bottle neck I, i.e. in coupling engagement with the strips 13. In this connection, due to the opposite direction of the threads, there is an unscrewing of the beaker 8, which falls into the inside of the bottle. The mixing of the two components A and B takes place. With the complete screwing-on of the bottle closure cap 1, the latter has then itself come into sealing closure with respect to the bottle neck I, in the manner that a sealing collar 22 which is developed on the bottom, or cover, of the closure cap 1 enters into the mouth of the bottle neck 9 and presses itself against the elastic inner edge there (see FIG. 2).

The sealing collar 22 extends concentrically to the collar 7 but is of substantially less height, so that only at the very last moment of the screwing-on movement does the corresponding sealing effect take place.

The bottle 5, developed as flat container has, in addition to the bottle neck I which has been described in detail, also an additional bottle neck II. The latter has the same thread as the bottle neck I, for which reason the bottle closure cap fits both thread connections. The reference numbers are employed by analogy.

Figure 6:
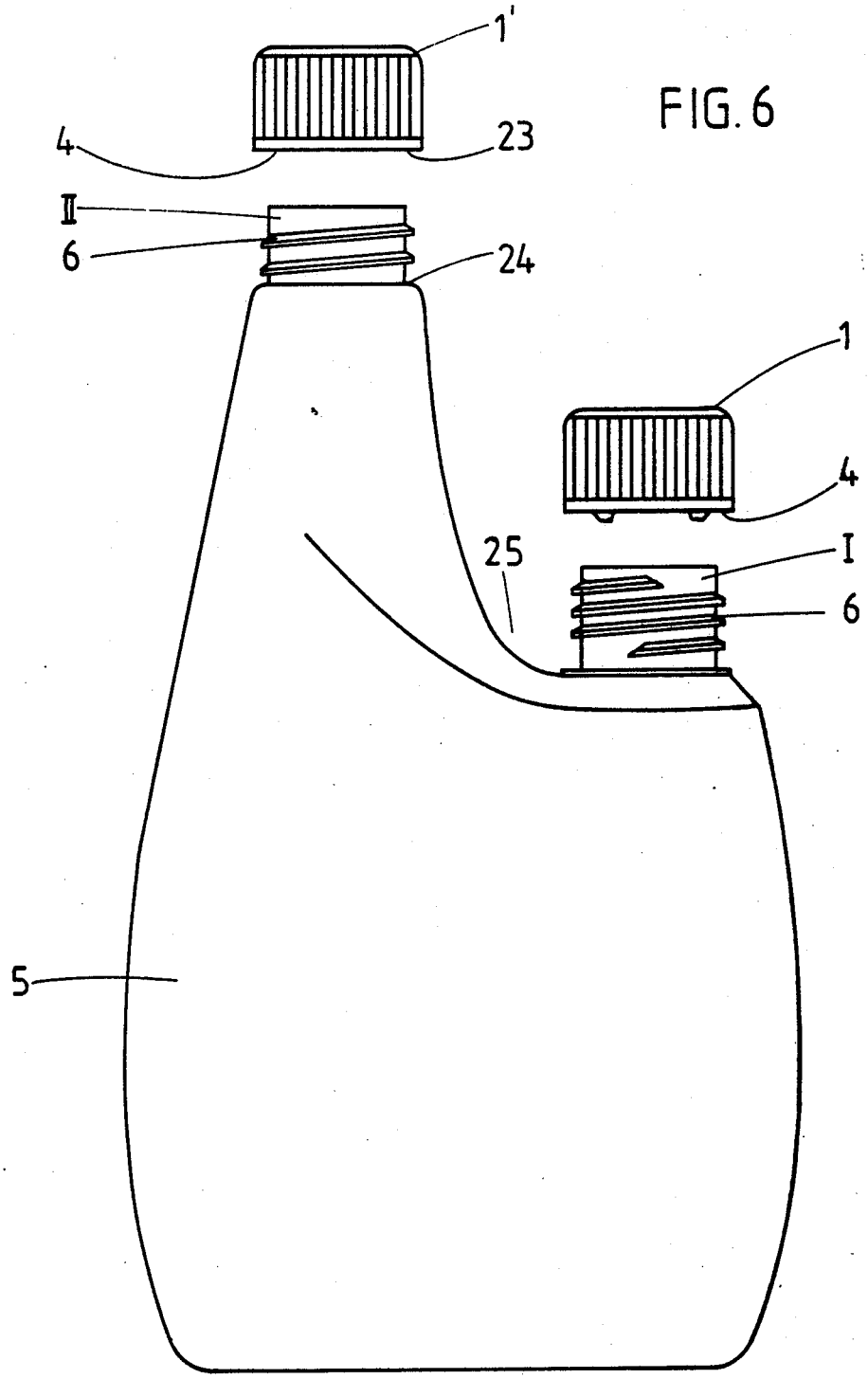
FIG. 6 is a side view of said bottle with the closure caps shown above the corresponding bottle necks.
Figure 7:
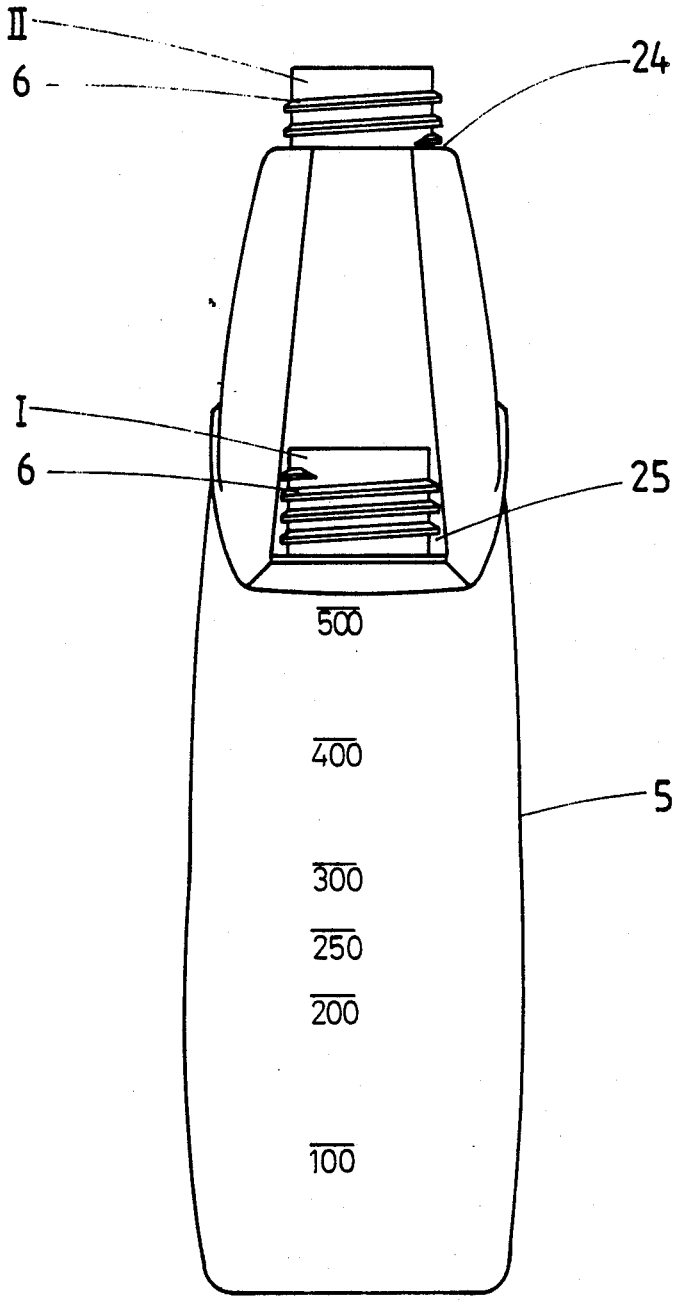
FIG. 7 is a side view thereof.

The bottle neck II as can be noted from a comparison of FIG. 6, clearly has a smaller height or axial length. In the screwed-on position, the cup edge 23 of the second closure cap 1' comes in sealing manner onto the shoulder 24 of the bottle neck II. The cup edge 23 can be developed in a liplike manner.

As can furthermore be noted from the top view of FIG. 5, this bottle neck II is not equipped with mating coupling means in the form of strips 13.

If a manner of use is desired in which the mixing of the components A and B takes place at a time which is determined by the user, then it is merely necessary to interchange the two bottle closure caps 1 and 1'. The bottle closure cap 1 provided with the beaker 8 has up to now been in tightly closing connection with the bottle neck II. In the absence of ledges 13 the mini-capsule remains closed there. A closure cap 1 not provided with beaker has been associated up to this point with the bottle neck I. Here the sealing closure is obtained via the sealing collar 22 explained above, so that the component B cannot escape.

Therefore the simple instruction to change the caps in order to produce the mixing is sufficient for the user.

As can be noted, the bottle necks I, II are arranged on different planes. For this purpose, the bottle 5 forms, to the side of a neck section extending tapered towards the free end, a niche 25 in the deeper lying horizontal step of which the bottle neck I is rooted.

The useful region of height of the bottle is graduated, as can be noted from FIG. 1, and provided with indications as to amount of filling.

We claim:

1. A closure cap system for a bottle in a two-component package, comprising a cup-shaped closure cap with a thread extending along an inner wall of the cap for engaging a screw-on thread of said bottle;

a container having a cylindrical wall with a thread on the inner side and projections on the outer side of the cylindrical wall, said container being insertable within a neck of the bottle to be closed by said cap;

a collar extending from the bottom of the cup-shaped cap, the collar having a thread engageable with the container thread for bearing said container via said container thread, said collar thread being directed opposite the cap thread to bring the container guided by said projections into non-rotatably but axially displaceable coupling engagement with an inner wall of the bottle neck; and wherein an annular groove is located on the bottom of the container, and an end of the collar fits within said annular groove.

2. A closure cap system according to claim 8, wherein a peripheral portion of the bottom of the container is configured with an annular step; and said annular groove on the bottom of the container lies between and is immediately adjacent the container cylindrical wall and said annular step on the container bottom resulting in a U-shaped profile to said annular groove.

3. A closure cap system according to claim 1, wherein said end of the collar, which end enters into the annular groove, is reduced in its wall thickness.

4. A closure cap system according to claim 1, wherein said projections on said container are formed by radially protruding, axially extending ribs, the ribs passing beneath said annular groove.

5. A closure cap system according to claim 1, wherein the axial course of the projections extends over the entire axial length of the cylindrical wall of the container.

6. A closure cap system according to claim 1, further comprising stiffening ribs disposed on the inner wall of said collar.

7. A closure cap system according to claim 1, including a bottle, and wherein said bottle includes a second bottle neck adjacent said first-mentioned neck and having a thread identical to a thread of said first-mentioned neck; said system further comprising;

a second closure cap seated on said second neck; and wherein the second closure cap has a cup edge which sits in sealing manner on a shoulder of the second bottle neck, the length of the second bottle neck being shorter than the axial length of the cap wall of the first-mentioned closure cap.

* * * * *